US007040134B2

(12) United States Patent
Akahane et al.

(10) Patent No.: US 7,040,134 B2
(45) Date of Patent: May 9, 2006

(54) PUNCH FOR FORGING A LIQUID EJECTION HEAD

(75) Inventors: Fujio Akahane, Nagano (JP); Nagamitsu Takashima, Nagano (JP); Kazushige Hakeda, Nagano (JP); Ryoji Uesugi, Nagano (JP); Akiharu Kurebayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/644,898

(22) Filed: Aug. 21, 2003

(65) Prior Publication Data

US 2004/0055353 A1 Mar. 25, 2004

(30) Foreign Application Priority Data

Aug. 23, 2002 (JP) ..... 2002-243484
Aug. 19, 2003 (JP) ..... 2003-207934

(51) Int. Cl.
*B21D 28/10* (2006.01)

(52) U.S. Cl. ..... 72/324; 72/377; 72/352; 29/890.142

(58) Field of Classification Search ..... 72/324, 72/385, 377, 379.2, 343, 352, 267; 29/890.142, 29/890.03

See application file for complete search history.

(56) References Cited

U.S. PATENT DOCUMENTS 2,835,960 A * 5/1958 Rork ..... 29/889.23
3,521,472 A * 7/1970 Bringewald ..... 72/184
3,748,889 A * 7/1973 Miller et al. ..... 72/382
3,861,191 A * 1/1975 Sato et al. ..... 72/267
4,434,643 A * 3/1984 Almqvist et al. ..... 72/379.6
4,706,051 A * 11/1987 Dieleman et al. ..... 333/212
6,167,739 B1 * 1/2001 Sipila ..... 72/267
6,189,363 B1 * 2/2001 Lai ..... 72/358
6,681,612 B1 * 1/2004 Matsumoto et al. ..... 72/415

FOREIGN PATENT DOCUMENTS

JP 2000-108349 A 4/2000

* cited by examiner

*Primary Examiner*—Daniel C. Crane
(74) *Attorney, Agent, or Firm*—Sughrue Mion, PLLC

(57) ABSTRACT

A male die for forming a member incorporated in a liquid ejection head is disclosed. Each of a plurality of first forging punches is operable to form a first recess on a metal plate. The first forging punches are arranged at a fixed pitch to form a punch row in a first direction. Each of a plurality of second forging punches is operable to form a second recess on the metal plate. The second forging punches are arranged adjacently to first forging punches located at both ends of the punch row. The first recess is to be a first part of the member which is used to eject liquid from the liquid ejection head, and the second recess is to be a second part of the member which is not used to eject liquid.

12 Claims, 12 Drawing Sheets

PUNCH FOR FORGING A LIQUID EJECTION HEAD

BACKGROUND OF THE INVENTION

The present invention relates to a forging punch to be practically used in manufacturing a component such as a liquid ejection head. The present invention also relates to a manufacturing method by using the same punch and a liquid ejection head manufactured by the method.

Forging work is used in various fields of products. For example, it is thought that a pressure generating chamber of a liquid ejection head is molded by forging metal material. The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber r and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber.

The silicon substrate described above has a problem that a manufacturing process is complicated. Therefore, it has been noted that the pressure generating chamber of a recording head is formed by carrying out forging over a metal material. In this case, a large number of pressure generating chambers taking the shape of an elongated recess are arranged side by side in a row. In the vicinity of the end of the pressure generating chambers provided in the row, there is presented a phenomenon in which the flow deformation of the metal material is different from a flow deformation in the middle part of the row. Thus, it is hard to uniformly form all the pressure generating chambers.

Meanwhile, according to the above-described related-art recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

SUMMARY OF THE INVENTION

It is therefore an object of the invention to provide a forging punch which is capable of forming pressure generating chambers in a metal substrate while solving the above problems.

In order to achieve the above object, according to the invention, there is provided a male die, comprising:

a plurality of first forging punches, each of which is operable to form a first recess on a metal plate, the first forging punches arranged at a fixed pitch to form a punch row in a first direction; and a plurality of second forging punches, each of which is operable to form a second recess on the metal plate, th second forging punches arranged adjacently to first forging punches located at both ends of the punch row, wherein the first recess is to have a first function, and the second recess is to have a dummy function in connection with the first function.

Here, it is preferable that: the metal plate is to be a member incorporated in a liquid ejection head; and the first recess is to be a first part of the member which is used to eject liquid from the liquid ejection head, and the second recess is to be a second part of the member which is not used to eject liquid.

In the forging work using the above male die, the first recesses arranged are simultaneously formed by the first punches. Incidentally, a plastic deformation occurs such that the first recesses are arranged on both sides of the first recess which is in the center portion of the recess row, while the first recess is formed on one side of the first recess which is in an end of the recess row. Accordingly, deformation behaviors are different between the center portion of the recess row and the end of the recess row, so that the shapes of the first recesses thus formed become uniform with difficulty.

More specifically, when the first punch is pressed against the metal plate as described above, the metal plate in the vicinity of each of the first punches flows to be shifted little by little in the direction of the punch row. Finally, the flow amounts are accumulated so that the first recesses on both ends of the recess row and the first recess in a middle part of the recess row have different dimensions or shapes. Even if a degree of the difference is very low, a variation in the behavior (the ejection prop rty of the liquid ejection head, for example) of the first recess is generated.

However, since the second recess does not perform the original function of first recess, there is no problem even when the plastic deformation is accumulated at the second recess so as to have abnormal dimension or shape. On the other hand, the even first recesses formed adjacently to the second recess can be maintained in a desired state.

Preferably, a plurality of second forging punches are provided at each end of the punch row. In this case, the function of absorbing the accumulated plastic deformation of the second recess can be enhanced.

Preferably, a depth dimension of a first gap defined between adjacent ones of the first forging punches and the second forging punches is smaller than a depth dimension of a second gap defined between adjacent ones of the first forging punches.

In this case, since the second gap is first fulfilled with the material flown by the press movement of the male die, the first recesses are formed under a condition that the plastic flow of the material toward the second punches is remarkably restricted. Accordingly, even the first recess adjacent to the second recess can be formed with sufficient amount of the material as well as the first recesses arranged in the center of the row.

Here, it is preferable that a depth dimension of a third gap defined between adjacent ones of the second forging punches is smaller than the depth dimension of the first gap.

It is further preferable that the depth dimension of the third gap defined between adjacent ones of the second forging punches which are closer to the end of the punch row is smaller than the depth dimension of the third gap defined between adjacent ones of the second forging punches which are further from the end of the punch row.

In these cases, the above advantageous restriction effect can be further enhanced.

It is also preferable that a width dimension of each of the first forging punches is identical with a width dimension of each of the second forging punches.

In this case, Fe structure of the male die can be simplified so that the equipment cost can be reduced.

Alternatively, a width dimension of each of the first forging punches may be smaller than a width dimension of each of the second forging punches. Also in this case, the above advantageous restricting effect can be attained.

Alternatively, the second forging punches am extended closer to the metal plate to be processed than the first forging punches. Also in this case, the above advantageous restricting effect can be attained. Further, this effect can be realized at the initial stage of the forging work because the second forging punches are first pressed against the metal plate.

Preferably, each of the first forging punches and each of the second forging punches are elongated in a second direction which is perpendicular to the first direction.

In a case where the first recesses and the second recesses formed by the forging punches are so configured as to have such a shape, the first recess arranged in the end of the recess row tends to have an abnormal dimension or shape due to the accumulation of the plastic flow of the material. However, as the second recesses are formed in the above described manner, such an inconvenient situation can be avoided.

Preferably, the male die further comprises a plurality of third forging punches, each of which is operable to form a third recess on the metal plate and arranged between one of the first forging punches and one of the second forging punches. Here, a width dimension of each of the first forging punches is identical with a width dimension of each of the third forging punches, and the third recess is to have the dummy function.

In this case, even if the advantageous effect obtained by the second recesses is insufficient, since the third recesses serving as a buffer can compensate the insufficiency, the first recesses can be formed as desired.

Preferably, the fixed pitch is 0.3 mm or less. Even when such minute portions are formed, precise forging work can be realized.

According to the invention, there is also provided a liquid ejection head, comprising:

a first metallic plate member, formed with:

a plurality of first recesses, arranged at a fixed pitch to form a recess row, and a plurality of second recesses, arranged adjacently to first recesses located at both ends of the recess row; and a second metallic plate member, joined to the first metallic plate member, and formed with a plurality of nozzle orifices each communicated with one of the first recesses and operable to eject liquid therefrom by pressure fluctuation generated in liquid contained in the one of the first recesses, wherein a shape of each of the first recesses is different from a shape of each of the second recesses.

Preferably, a plurality of second recesses are provided at each end of the recess row.

Here, it is preferable that adjacent ones of the second recesses are partly communicated with each other.

It is further preferable that a width dimension of each of the first recesses is identical with a width dimension of each of the second recesses.

Alternatively, a width dimension of each of the first recesses is smaller than a width dimension of each of the second recesses.

Alternatively, a depth dimension of each of the first recesses is smaller than a depth dimension of each of the second recesses.

It is preferable that: the first metallic plate member is formed with a plurality of third recesses each arranged between one of the first recesses and one of the second recesses; a width dimension of each of the first recesses is identical with a width dimension of each of the third recesses; and the third recesses are not so configured as to eject liquid from the nozzle orifices.

Preferably, the fixed pitch is 0.3 mm or less.

According to the invention, there is also provided a method of manufacturing a liquid ejection head, comprising steps of:

providing a first metallic plate member;

providing the male die comprising a plurality of first forging punches arranged at a fixed pitch to form a punch row, and a plurality of second forging punches arranged adjacently to first forging punches located at both ends of the punch row;

forming simultaneously a plurality of first recesses with the first forging punches and a plurality of second recesses with the second forging punches;

providing a second metallic plate member formed with a plurality of nozzle orifices; and joining the first metallic plate member and the second metallic member such that each of the nozzle orifices is communicated with one of the first recesses, wherein a shape of each of the first recesses is different from a shape of each of the second recesses.

According to the invention, there is also provided a forging apparatus comprising the above male die.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
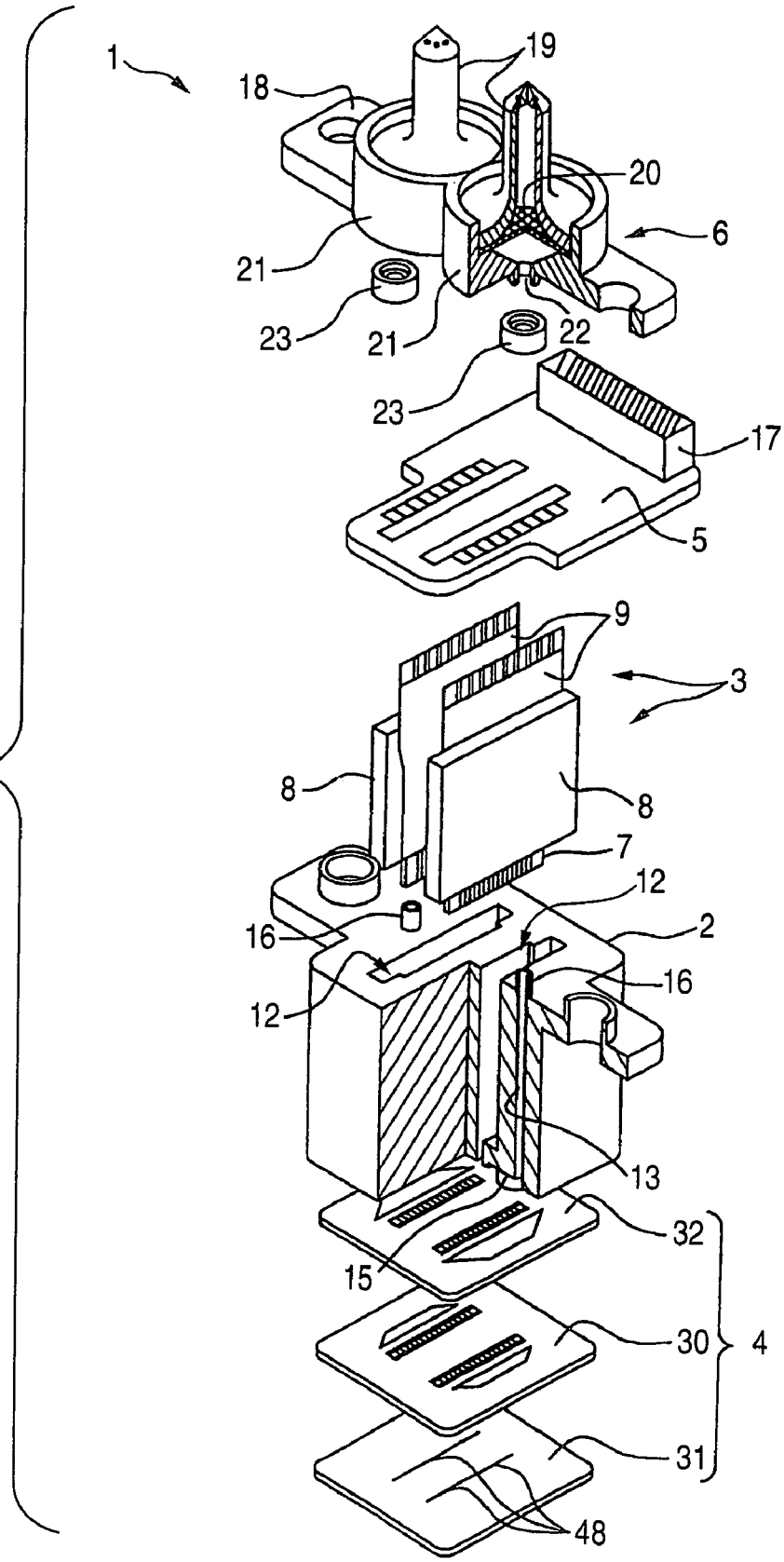
FIG. 1 is a perspective view of a disassembled ink jet recording head according to a first example.
Figure 2:
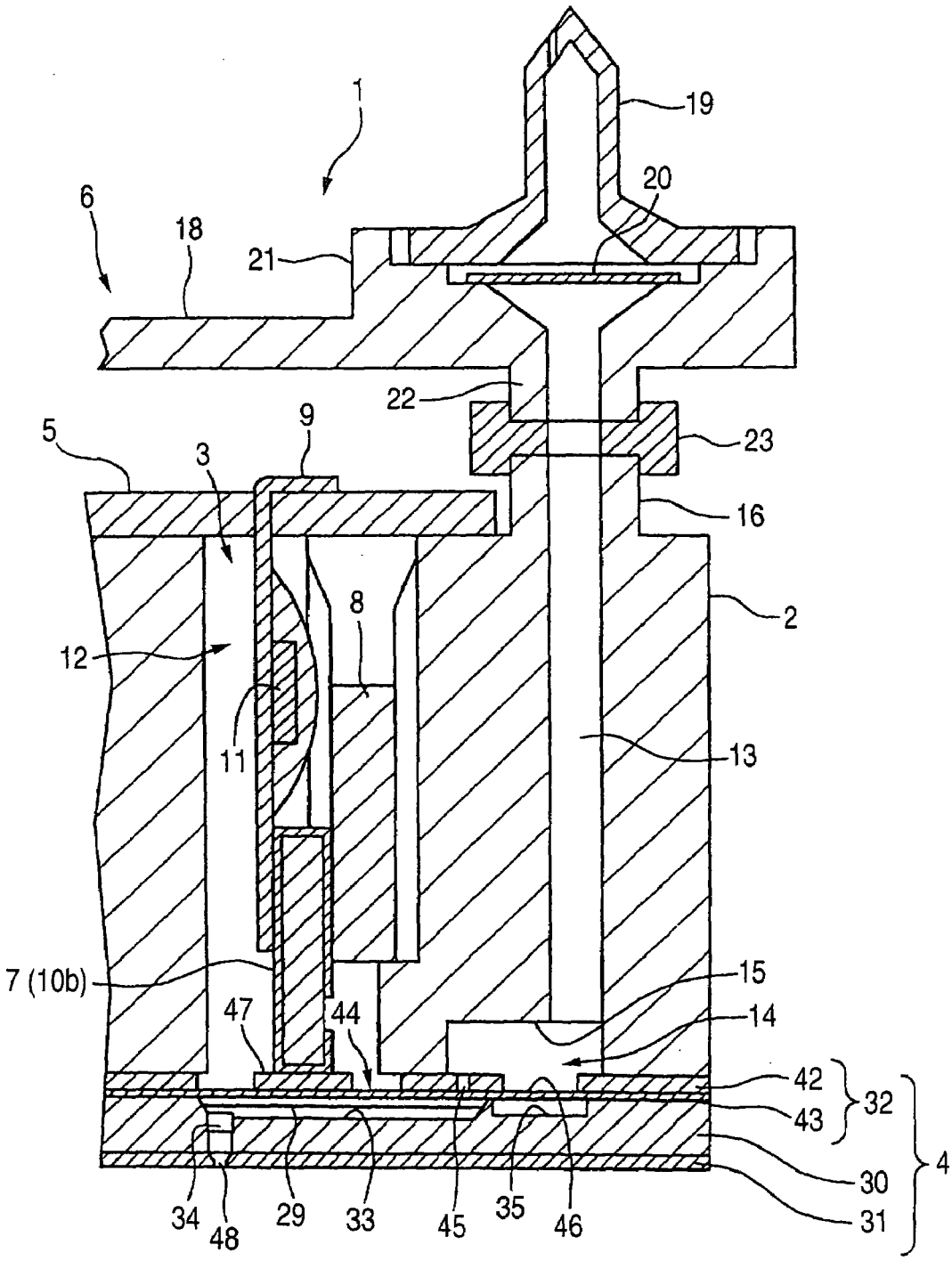
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
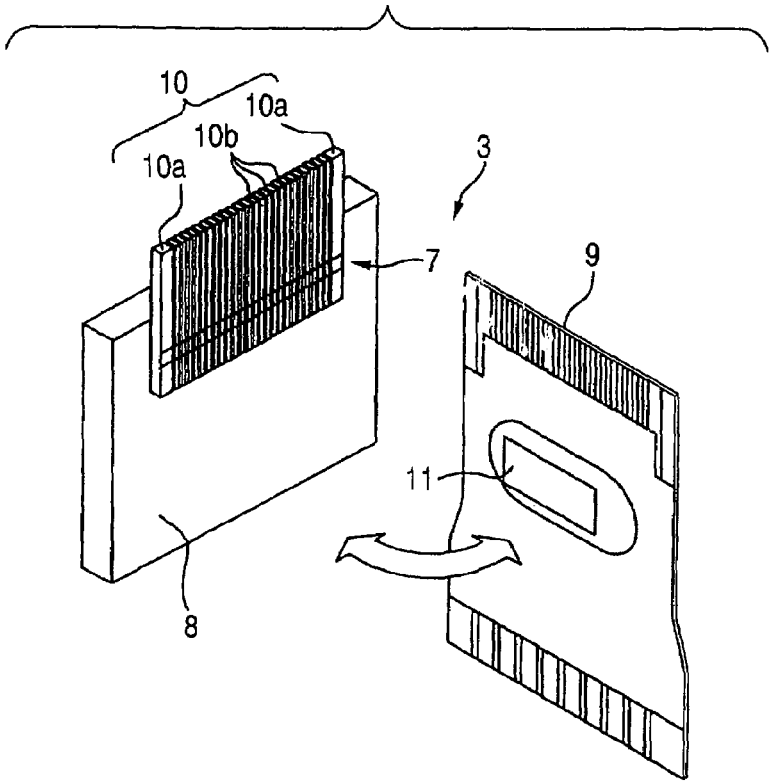
FIGS. 3A and 3B are views for explaining a vibrator unit.
Figure 3B:
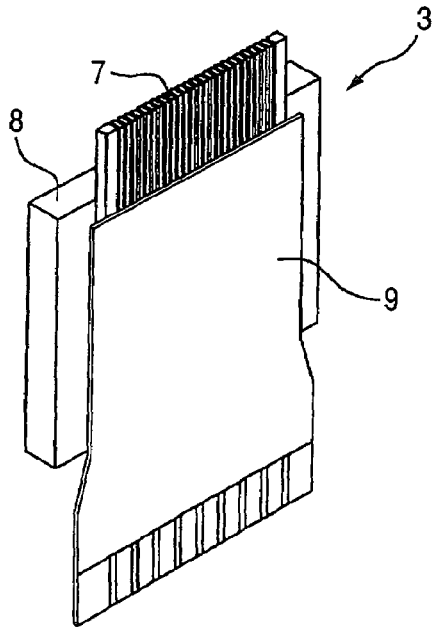

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-like member having a rigidity capable of receiving reaction force from the piezoelectric vibrators 10, and a metal plate of a stainless steel plate or the like is preferably used therefor.

The casing 2 is a block-like member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpen d in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
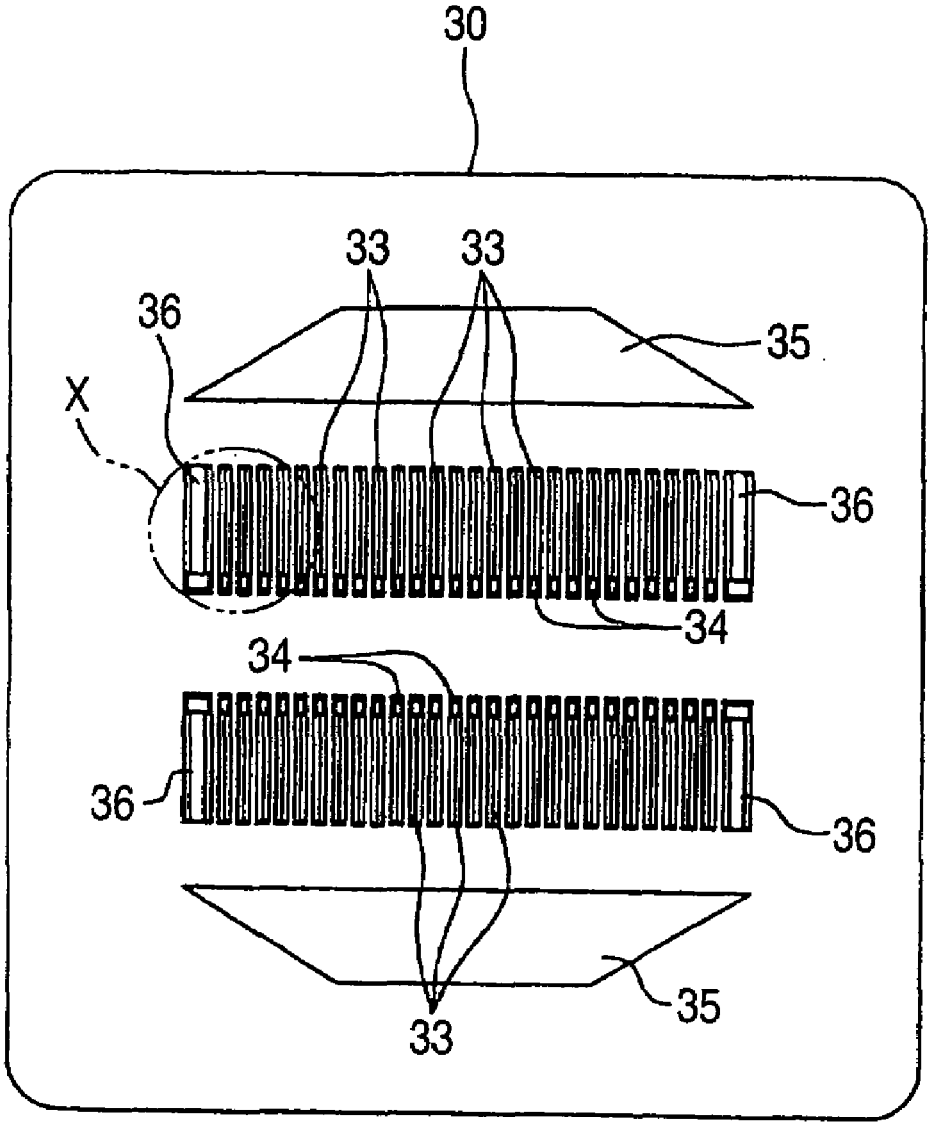
FIG. 4 is a plan view of a chamber formation plate.

As shown in FIG. 4, the chamber formation plate 30 is a plate-like member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
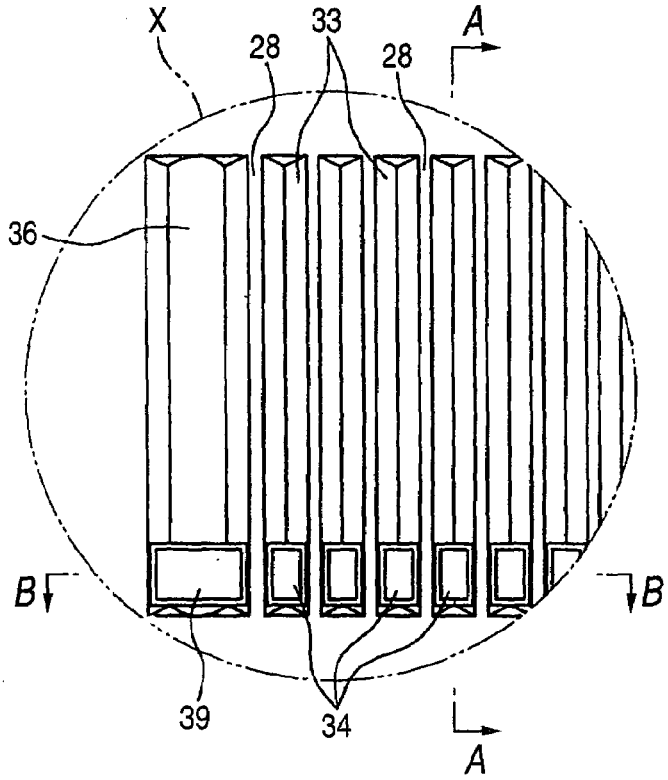
FIG. 5A is a view enlarging an X portion in FIG. 4.
Figure 5B:
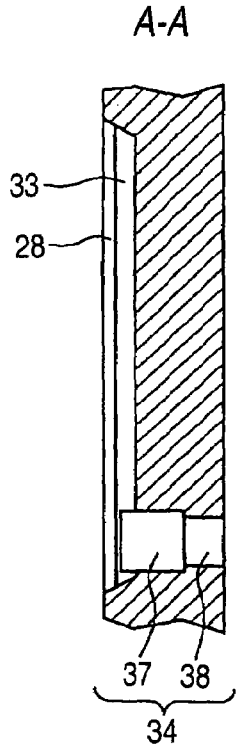
FIG. 5B is a sectional view taken along a line A—A of FIG. 5A.
Figure 5C:
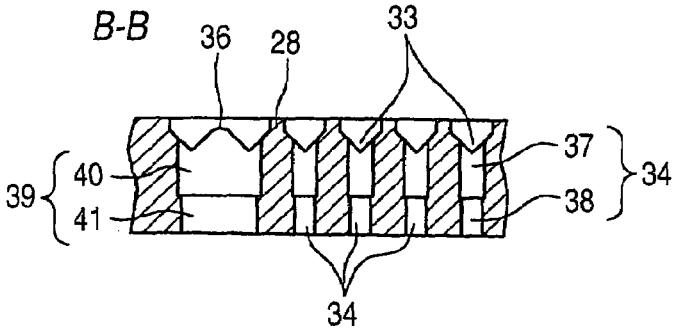
FIG. 5C is a sectional view taken along a line B—B of FIG. 5A.

The elongated recess portion 33 is a recess portion in a groove-like shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-like shape by reducing a width thereof as progressing in a depth direction (that is, depth side). The bottom face is recessed in the V-like shape to increase a rigidity of a partition wall 28 for partitioning the contiguous pressure generating chambers 29. That is, by recessing the bottom face in the V-like shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-like shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-like shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-like shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 6:
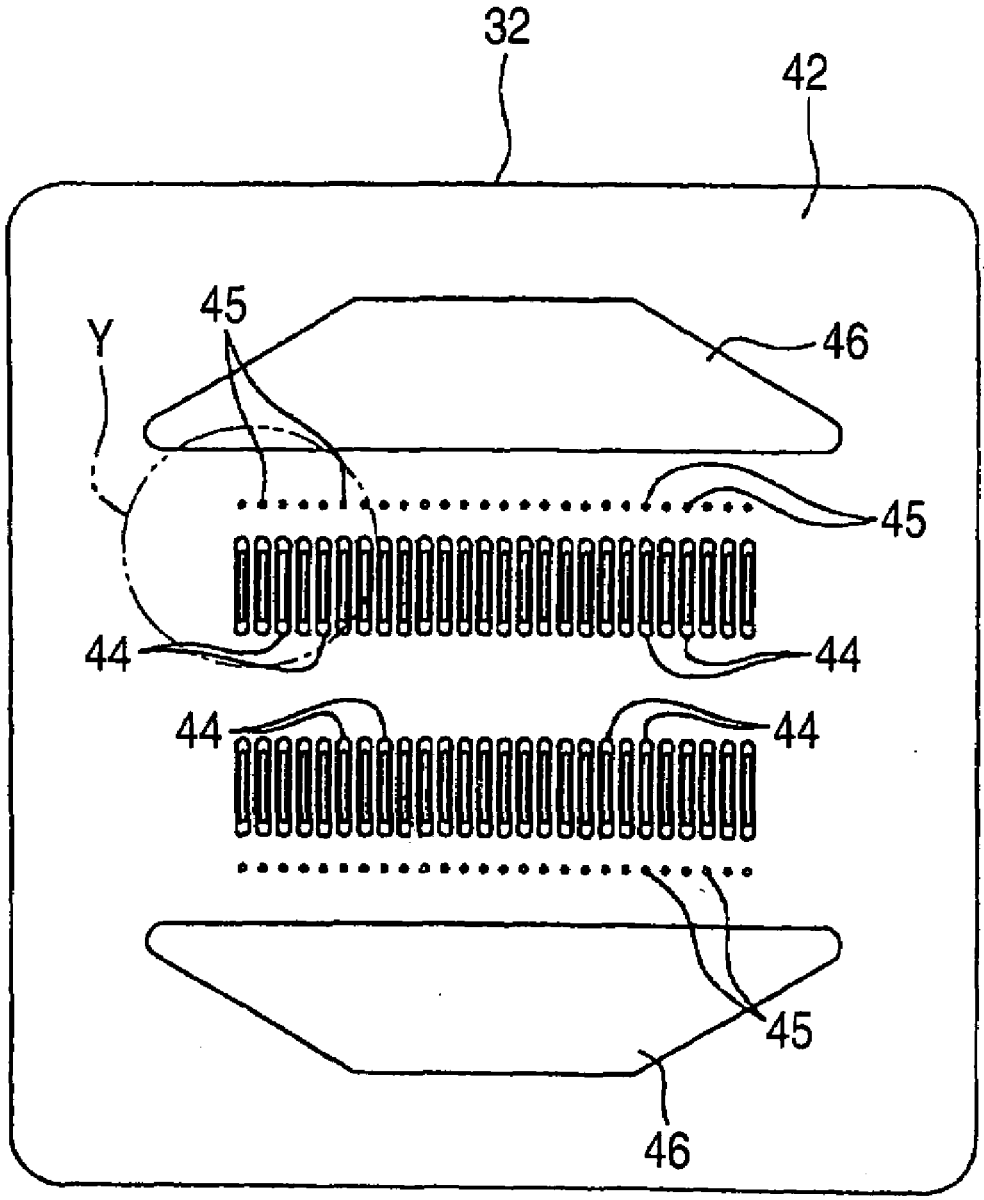
FIG. 6 is a plan view of an elastic plate.

As shown in FIG. 6, the elastic plate 32 is formed with a diaphragm portion 44, an ink supply port 45 and the compliance portion 46.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
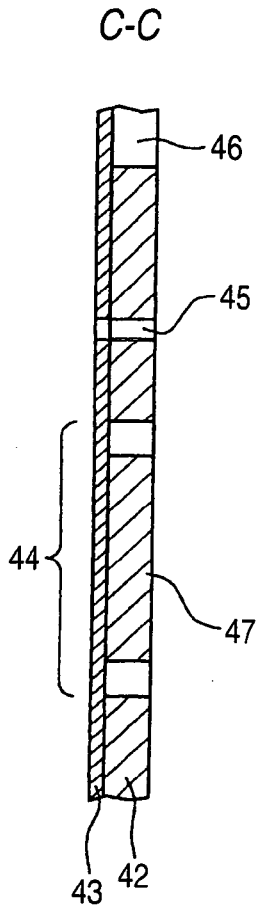
FIG. 7B is a sectional view taken along a line C—C of FIG. 7A.
Figure 7A:
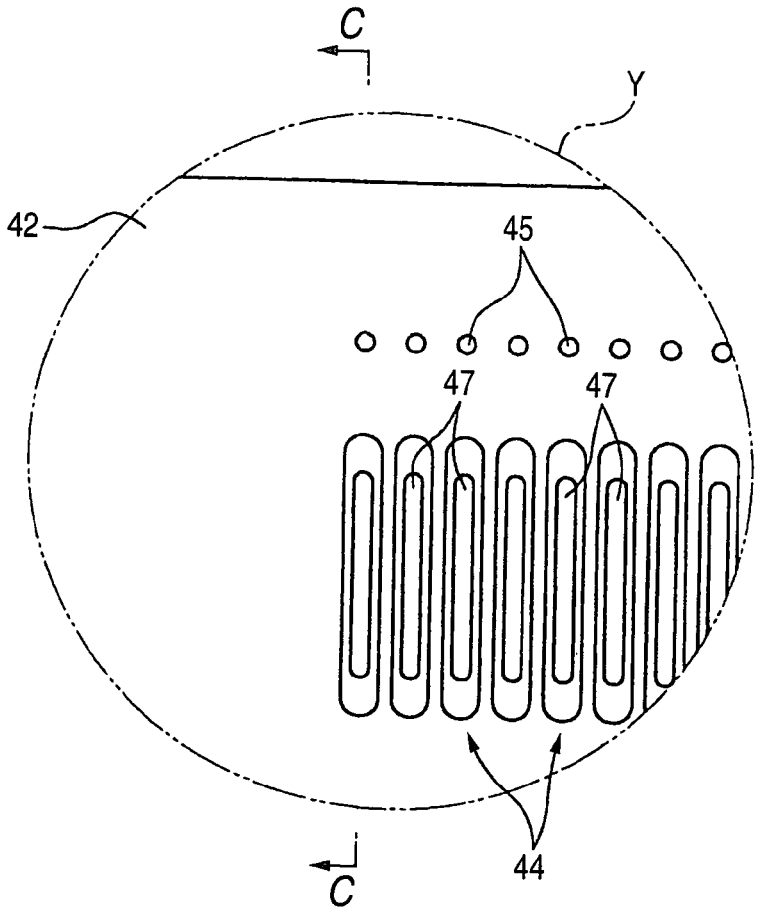
FIG. 7A is a view nlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Next, the above-described nozzle plate 31 will be explained. The nozzle plate 31 is a plate-like member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink. Further, the above-described escaping recess portion 35 forms a space for allowing the elastic film 43 to be expanded.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-like shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when the fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plat 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, them width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a metal plate 55 used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 8A:
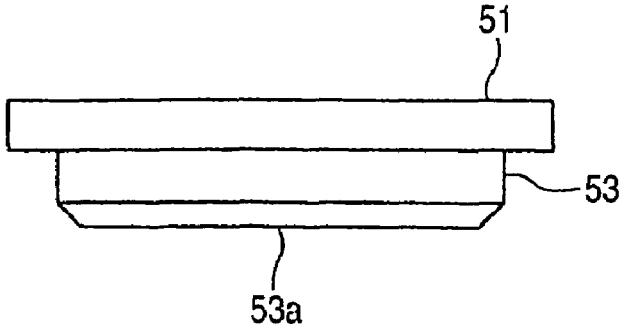
FIGS. 8A and 8B are views for explaining a first male die used in forming an elongated recess portion.
Figure 8B:
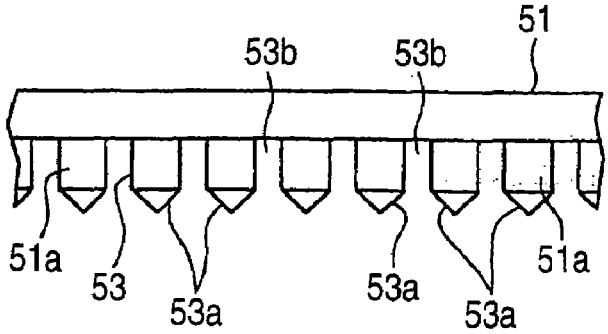
Figure 9A:
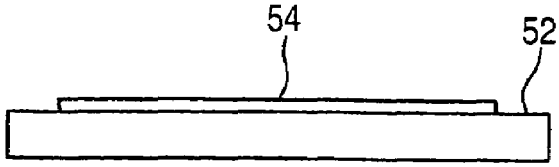
FIGS. 9A and 9B are views for explaining a female die used in forming the elongated recess portion.
Figure 9B:
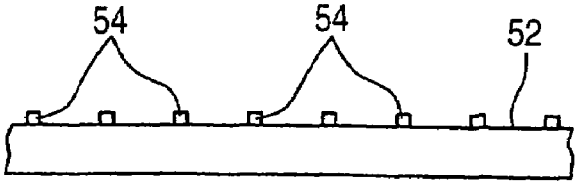

In the elongated recess portion forming steps, a first male die 51 shown in FIGS. 8A and 8B and a female die shown in FIGS. 9A and 9B are used. The first male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-like shape in view from a longitudinal direction thereof. Further, both longitudinal ends of the distal end portions 53A are tapered by an angle of about 45 degrees as shown in FIG. 8A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 10A:
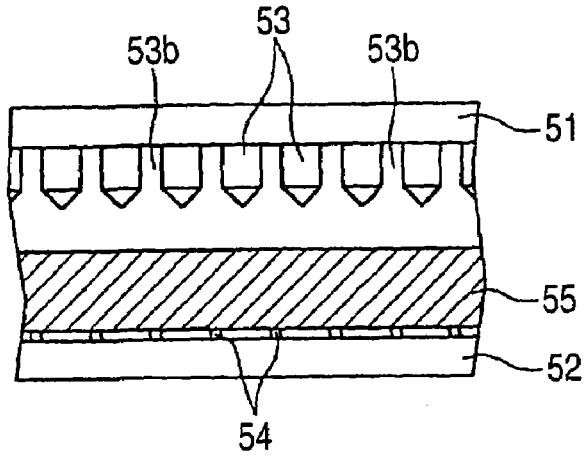
FIGS. 10A to 10C are views for explaining a step of forming the elongated recess portion.
Figure 10B:
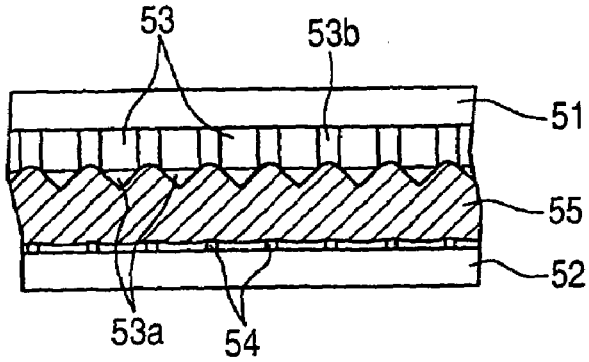
Figure 10C:
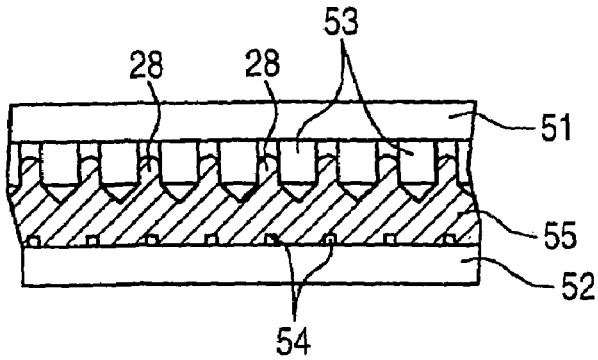

In the elongated recess portion forming steps, first, as shown in FIG. 10A, the metal plate 55 is mounted at an upper face of the female die 52 and the first male die 51 is arranged on an upper side of the metal plate 55. Next, as shown in FIG. 10B, the first male die 51 is moved down to push the distal end portion of the projection 53 into the metal plate 55. At this occasion, since the distal end portion 53*a* of the projection 53 is sharpened in the V-like shape, the distal end portion 53*a* can firmly be pushed into the metal plate 55 without buckling. Pushing of the projection 53 is carried out up to a middle in a plate thickness direction of the metal plate 55 as shown in FIG. 10C.

By pushing the projection 53, a portion of the metal plate 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the metal plate 55 pushed by the distal end portion 53*a* flows smoothly, the elongated recess portion 33 to be formed is formed in a shape following the shape of the projection 53. Further, since the both longitudinal ends of the distal end portion 53*a* are tapered, the metal plate 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the metal plate 65 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the metal plate 55 is raised into a space between the contiguous projections 53 by being pressed by the projections 53. In this case, the projection 54 provided at the female die 52 is arranged at a position in correspondence with an interval between the projections 53, flow of the metal plate 55 into the space is assisted. Thereby, the metal plate 55 can efficiently be introduced into the space between the projections 53 and the protrusion (i.e., the partition wall 28) can be formed highly.

FIGS. 11A through 14 show embodiments of the forging punch. Portions serving as the portions described above are designated by the same reference numerals in the drawings.

Plastic working is performed on the metal plate 55 by the male die 51 and the female die 52 under condition of room temperature, and plastic working described below is performed similarly under condition of room temperature.

Although dummy forging punches (described later) are provided on both ends of a mal die 51, only one side is shown in the drawings.

Figure 11A:
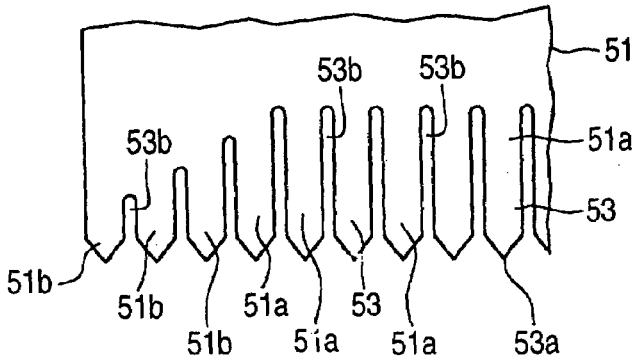
FIG. 11A is a side view showing a male die of a forging punch according to a first embodiment of the invention.

As shown in FIG. 11A, in a male die 51 of a forging punch according to a first embodiment, the width of the projections 53, that is, the forging punches 51*a* are made uniform in a direction in which they are arranged side by side. Three dummy forging punches 51*b* are arranged on both ends of the male die 51, and the depth of the gap portion 53*b* formed between the dummy forging punches 51*b* is set to be smaller than that of the gap portion 53*b* formed between the forging punches 51*a*.

Further, the depth of the closest gap portion 53*b* to the end of the male die 51 is set to be the smallest and the depth of the gap portion 53*b* is gradually increased with a separation therefrom. Thus, the depth of the adjacent gap portion 53*b* is sequentially increased to be coincident with the depth of the gap portion 53*b* of the forging punch 51*a*.

Figure 11B:
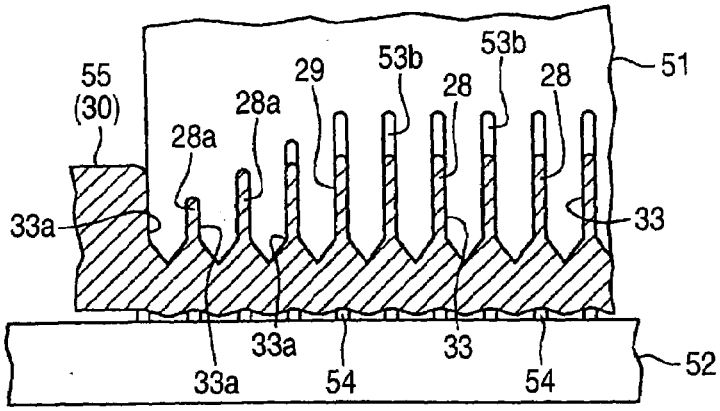
FIG. 11B is a side view showing a state that the male die is pressed against a metal plate.

When the male die 51 is pressed against a metal plate 55 which is to be the chamber formation plate 30 and formed of nickel, as shown in FIG. 11B, the forging punch 51*a* and the dummy forging punch 51*b* are pressed into the metal plate 55 so that the pressed material flows into the gap portion 53*b*. The gap portion 53*b* closest to the end of the male die 51 is first fulfilled with the flown material. As the male die 51 is further pressed against the metal plate 55, the adjacent gap portion 53*b* is subsequently fulfilled with the flown material.

In the forging work using the forging punch, the pressure generating chambers 29 arranged in a row at a predetermined pitch are simultaneously formed by the forging punches 51*a* arranged in a row at the predetermined pitch. For this reason, a plastic deformation occurs such that the pressure generating chambers 29 are arranged on both sides of the pressure generating chamber 29 which is in the center portion of the row, while the pressure generating chamber 29 is formed on one side of the pressure generating chamber 29 which is in an end of the row. Accordingly, deformation behaviors are different between the center portion of the row and the end of the row, so that the shapes of the pressure generating chambers 29 thus formed become uniform with difficulty.

More specifically, when the forging punch 51*a* is pressed against the metal plate 55 as described above, the metal plate 55 in the vicinity of each of the forging punches 51*a* flows to be shifted little by little in the direction of the row. Finally, the flow amounts are accumulated so that the pressure generating chambers 29 on both ends of the row and the pressure generating chamber 29 in a middle part of the row have different dimensions or shapes. Even if a degree of the difference is very low, a variation in the behavior (the ink drop ejecting property of the recording head 1, for example) of the pressure generating chamber 29 is generated.

However, since the dummy chamber 33*a* does not perform the original function of pressure generating chamber 29, there is no problem even when the plastic deformation is accumulated at the dummy chamber 33*a* so as to have abnormal dimension or shape. On the other hand, even the pressure generating chambers 29 formed adjacently to the dummy chamber 33*a* can be maintained in a desired state.

In a case where a plurality of dummy chambers 33*a* are provided in each end of the row of the pressure generating chambers 29, the above advantages can be further enhanced.

Since the gap portions 53*b* between the dummy forging punches 51*b* are first fulfilled with the material flown by the press movement of the male die 51, the pressure generating chambers 29 are formed under a condition that the plastic flow of the material toward the dummy forging punches 51*b* is remarkably restricted. Accordingly, even the pressure generating chamber 22 adjacent to the dummy chamber 33*a* can be formed with sufficient amount of the material as well as the pressure generating chambers 29 arranged in the center of the row.

Since each of the pressure generating chambers 29 has an elongated recess shape, and each of the partition walls 28 are made thin extremely, the pressure generating chamber arranged in the end of the row tends to have an abnormal dimension or shape due to the accumulation of the plastic flow of the material. However, as the dummy chambers 33*a* are formed in the above described manner, such an inconvenient situation can be avoided.

Figure 12:
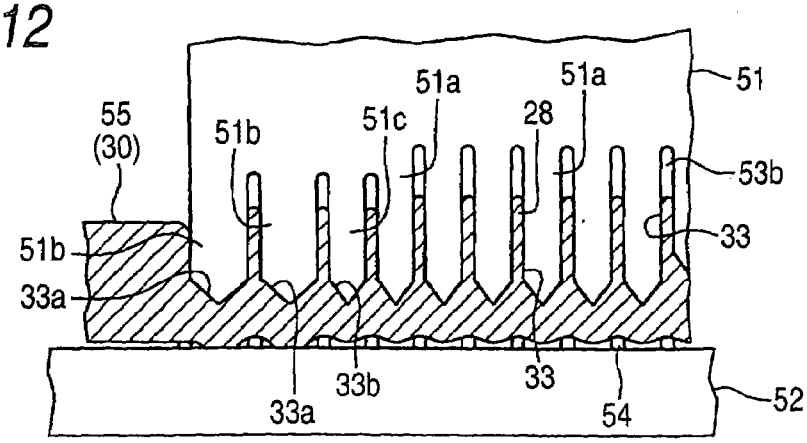
FIG. 12 is a side view showing a male die of a forging punch according to a second embodiment of the invention.

FIG. 12 shows a forging punch according to a second embodiment of the invention.

In this embodiment, the width of each dummy forging punch 51*b* for forming a dummy chamber 33*a* is set to be greater than that of each forging punch 51*a* for forming a pressure generating chamber 29. Other structures are the same as those of the first embodiment.

Since the dummy chamber 33 is press-molded by the dummy forging punches having the wider width, the pressure generating chambers 29 are formed under a condition that the plastic flow of the material toward the dummy forging punches 51*b* is remarkably restricted. Accordingly, even the pressure generating chamber 22 adjacent to the dummy chamber 33*a* can be formed with sufficient amount of the material as well as the pressure generating chambers 29 arranged in the center of the row.

Figure 13:
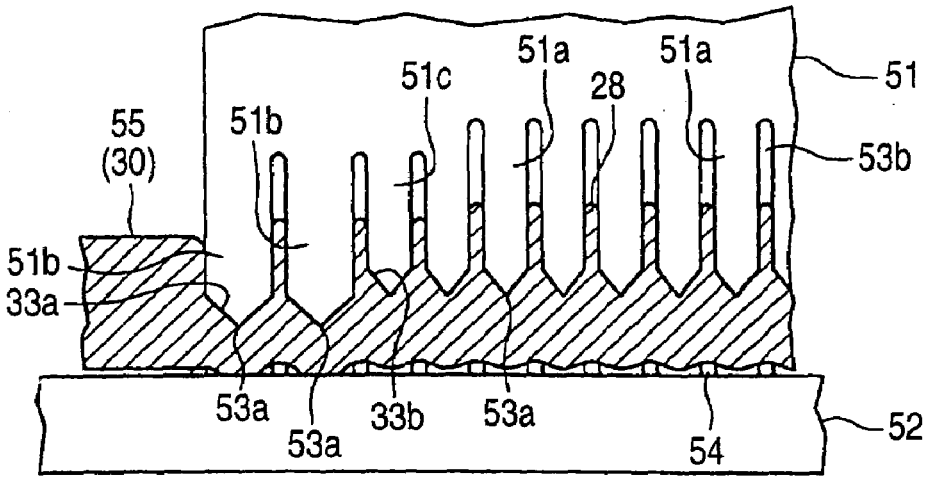
FIG. 13 is a side view showing a male die of a forging punch according to a third embodiment of the invention.

FIG. 13 shows a forging punch according to a third embodiment of the invention.

In this embodiment, a tip portion 53*a* of a dummy forging punch 51*b* for forming a dummy chamber 33*a* is protruded downward in comparison with a tip portion 53*a* of each forging punch 51*a* for forming a pressure generating chamber 29. Other structures are the same as those of the second embodiment.

Since the dummy forging punches 51*b* are protruded downward, the amount of material press-molded by the dummy forging punches 51*b* is increased, and the restriction can be realized at the initial stage of the press-molding. Accordingly, the pressure generating chambers 29 are formed under a condition that the plastic flow of the material toward the dummy forging punches 51*b* is remarkably restricted. Therefore, even the pressure generating chamber 22 adjacent to the dummy chamber 33*a* can be formed with sufficient amount of the material as well as the pressure generating chambers 29 arranged in the center of the row.

As shown in FIGS. 12 and 13, in the second and the third embodiments, a dummy forging punch 51*c* for forming a dummy chamber 33*b* having an almost equal width to the widths of pressure generating chambers 29 is provided between the dummy forging punch 51*b* and the forging punch 51*a*.

Even if the advantageous effect obtained by the dummy chamber 33*a* is insufficient, since the dummy chamber 33*b* serving as a buffer can compensate the insufficiency, the pressure generating chambers 29 can be formed as desired.

In the case of FIG. 13, since the dummy forging punch 51*b* having the wider width is protruded downward in comparison with the forging punch 51*c*, the formation of the dummy chamber 33*b* is less influenced so that precision in the formation of the pressure generating chambers 29 can be enhanced.

Figure 14:
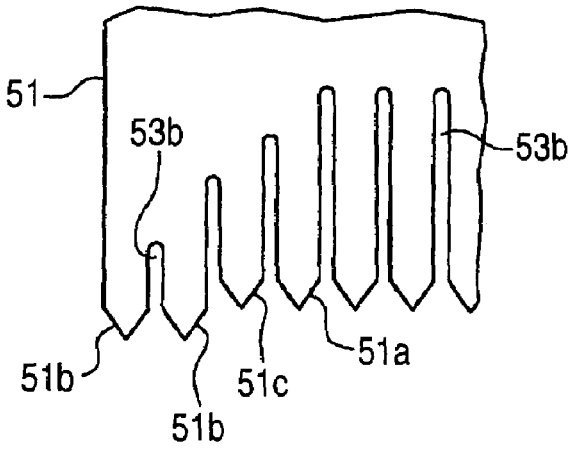
FIG. 14 is a side view showing a male die of a forging punch according to a fourth embodiment of the invention.

FIG. 14 shows a forging punch according to a second embodiment of the invention. This embodiment is so configured as to include all the features described in the above embodiments.

A pitch dimension of the forging punches 51*a* is 0.14 mm. When the pressure generating chamber 29 of the ink jet recording head, which is a precise minute member, is forged, very elaborate forging work is possible. Though the pitch dimension of the forging punches 51*a* is 0.14 mm in the shown embodiment, by setting this pitch 0.3 mm or less, the parts work of the liquid ejection head is finished more suitably. This pitch is preferably 0.2 mm or less, and more preferably 0.15 mm or less.

As a working method for such minute structure, an anisotropic etching method is generally adopted. However, since this method requires a large number of working steps, it is disadvantage in manufacturing cost. On the contrary, in a case where the above forging work method is used in the material such as nickel, the number of working steps is reduced greatly, which is very advantageous in cost.

The chamber formation plate 30 having the pressure generating chamber 29 having high precision which is thus obtained is incorporated in the liquid ejection head 1. Consequently, it is possible to obtain the liquid ejection head 1 having a stable liquid injecting characteristic.

Figure 15:
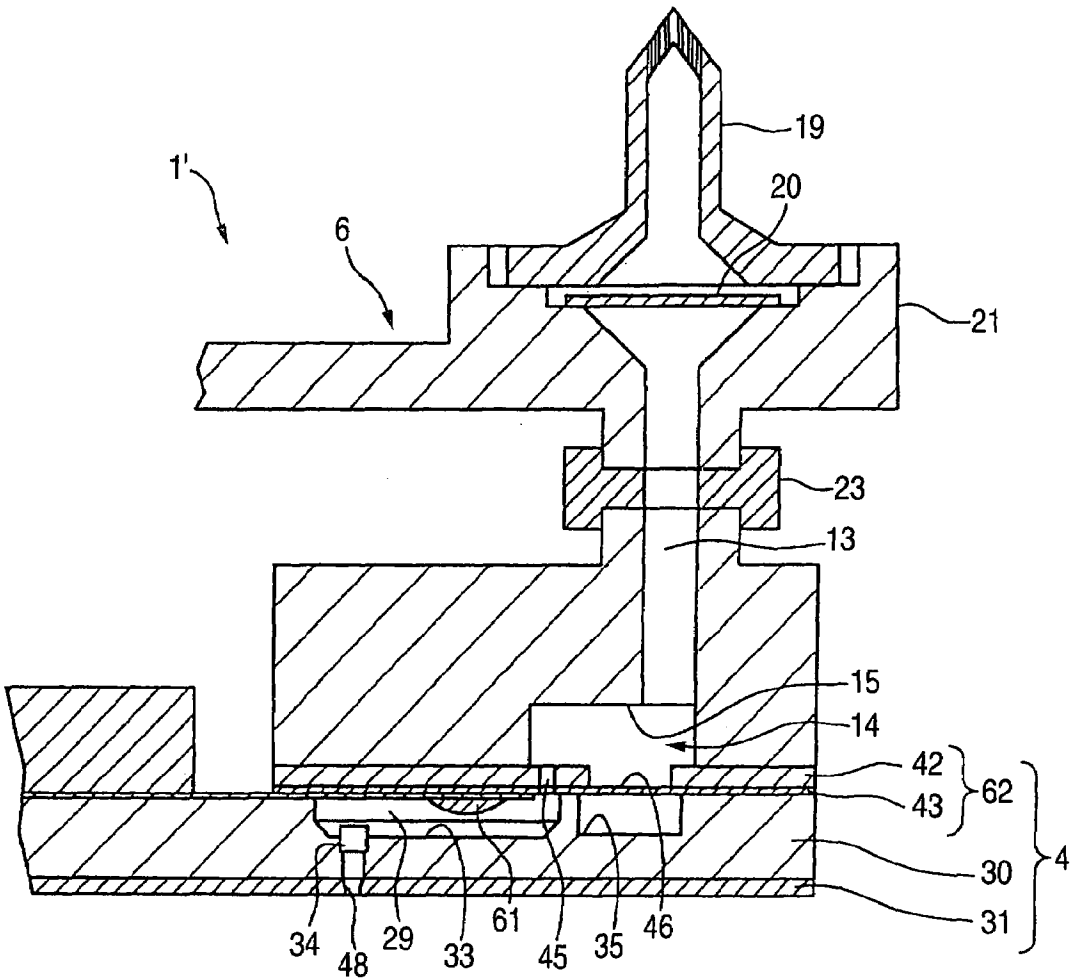
FIG. 15 is a sectional view for explaining an ink jet recording head according to a second example.

As a second example, a recording head 1' shown in FIG. 15 adopts a heat generating element 61 as the pressure generating element. According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above-described embodiments are achieved.

With regard to the communicating port 34, although according to the above-described embodiments, an example of providing the communicating port 34 at one end portion of the elongated recess portion 33 has been explained, the invention is not limited thereto. For example, the communicating port 34 may be formed substantially at center of the elongated recess portion 33 in the longitudinal direction and the ink supply ports 45 and the common ink reservoirs 14 communicated therewith may be arranged at both longitudinal ends of the elongated recess portion 33. Thereby, stagnation of ink at inside of the pressure generating chamber 29 reaching the communicating port 34 from the ink supply ports 45 can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

What is claimed is:

1. A male die, comprising:

a plurality of first forging punches, each of which is operable to form a first recess on a metal plate, the first forging punches arranged at a fixed pitch to form a punch row in a first direction; and a plurality of second forging punches, each of which is operable to form a second recess on the metal plate, the second forging punches arranged adjacently to first forging punches located at both ends of the punch row, wherein the first recess is adapted to have a first function, and the second recess is adapted to have a second function different from the first function;

wherein the metal plate is adapted to be a member incorporated in a liquid ejection head; and wherein the first recess is adapted to be a first part of the member which is used to eject liquid from the liquid ejection head.

2. The male die as set forth in claim 1, wherein a plurality of second forging punches are provided at each end of the punch row.

3. The male die as set forth in claim 1, wherein a depth dimension of a first gap defined between adjacent ones of the first forging punches and the second forging punches is smaller than a depth dimension of a second gap defined between adjacent ones of the first forging punches.

4. The male die as set forth in claim 1, wherein each of the first forging punches and each of the second forging punches are elongated in a second direction which is perpendicular to the first direction.

5. The male die as set forth in claim 1, wherein a width dimension of each of the first forging punches is smaller than a width dimension of each of the second forging punches.

6. The male die as set forth in claim 3, wherein a width dimension of each of the first forging punches is identical with a width dimension of each of the second forging punches.

7. The male die as set forth in claim 1, wherein the second forging punches are extended closer to the metal plate to be processed than the first forging punches.

8. The male die as set forth in claim 1, further comprising a plurality of third forging punches, each of which is operable to form a third recess on the metal plate and arranged between one of the first forging punches and one of the second forging punches, wherein:

a width dimension of each of the first forging punches is identical with a width dimension of each of the third forging punches; and the third recess is adapted to have a dummy function.

9. The male die as set forth in claim 1, wherein the fixed pitch is 0.3 mm or less.

10. A male die, comprising:

a plurality of first forging punches, each of which is operable to form a first recess on a metal plate, the first forging punches arranged at a fixed pitch to form a punch row in a first direction; and a plurality of second forging punches, each of which is operable to form a second recess on the metal plate, the second forging punches arranged adjacently to first forging punches located at both ends of the punch row, wherein the first recess is adapted to have a first function, and the second recess is adapted to have a second function different from the first function;

wherein a depth dimension of a first gap defined between adjacent ones of the first forging punches and the second forging punches is smaller than a depth dimension of a second gap defined between adjacent ones of the first forging punches; and wherein a depth dimension of a third gap defined between adjacent ones of the second forging punches is smaller than the depth dimension of the first gap.

11. The male die as set forth in claim 10, wherein the depth dimension of the third gap defined between adjacent ones of the second forging punches which are closer to the end of the punch row is smaller than the depth dimension of the third gap defined between adjacent ones of the second forging punches which are further from the end of the punch row.

12. A forging apparatus, having a male die, said forging apparatus comprising:

a plurality of first forging punches, each of which is operable to form a first recess on a metal plate, the first forging punches arranged at a fixed pitch to form a punch row in a first direction; and a plurality of second forging punches, each of which is operable to form a second recess on the metal plate, the second forging punches arranged adjacently to first forging punches located at both ends of the punch row;

wherein the metal plate is adapted to be a member incorporated in a liquid ejection head;

wherein the first recess is adapted to be a first part of the member which is used to eject liquid from the liquid ejection head;

wherein the second recess is adapted to be a second part of the member which is not used to eject liquid; and wherein the first recess is adapted to have a first function, and the second recess is adapted to have a dummy function in connection with the first function.

* * * * *